US009707799B2

(12) United States Patent
Dalisay et al.

(10) Patent No.: US 9,707,799 B2
(45) Date of Patent: Jul. 18, 2017

(54) PROCESS FOR PRINTING AND SECURING THREE-DIMENSIONAL PATTERN ON NON-FIBROUS SUBSTRATES AND ARTICLE COMPRISING NON-FIBROUS SURFACE HAVING THREE-DIMENSIONAL PATTERN THEREON

(71) Applicant: The Procter & Gamble Company, Cincinnati, OH (US)

(72) Inventors: Huberto Miel Dalisay, Cincinnati, OH (US); Matthew Richard Allen, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 600 days.

(21) Appl. No.: 14/219,466

(22) Filed: Mar. 19, 2014

(65) Prior Publication Data

US 2015/0266334 A1 Sep. 24, 2015

(51) Int. Cl.

| | |
|---|---|
| ***B44C 1/20*** | (2006.01) |
| ***B41M 7/00*** | (2006.01) |
| *B41M 3/16* | (2006.01) |

(52) U.S. Cl.

CPC ..... *B44C 1/20* (2013.01); *B41M 7/0036* (2013.01); *B41M 7/0045* (2013.01);
(Continued)

(58) Field of Classification Search

CPC ..... B44C 1/20; Y10T 428/13; Y10T 428/131; Y10T 428/1397; Y10T 428/24802;
(Continued)

(56) References Cited

U.S. PATENT DOCUMENTS

| | | | |
|---|---|---|---|
| 3,615,972 | A | 10/1971 | Morehouse |
| 5,325,781 | A | 7/1994 | Dupont |

(Continued)

FOREIGN PATENT DOCUMENTS

| | | | |
|---|---|---|---|
| AT | 12174 | U2 | 12/2011 |
| EP | 348372 | A2 | 12/1989 |

(Continued)

OTHER PUBLICATIONS

Ning Pan, On Uniqueness of Fibrous Materials, Design & Nature II. Eds: Collins, M. and Brebbia, C. WIT Press, Boston, 2004; 493-504.

(Continued)

*Primary Examiner* — Michael C Miggins
(74) *Attorney, Agent, or Firm* — James T. Fondriest

(57) ABSTRACT

A process for creating a stable 3D pattern on a non-fibrous substrate comprises depositing a heat-expandable composition on the substrate; causing the disposed composition to expand in volume, thereby forming a 3D pattern having a perimeter; causing the composition to solidify; and applying a varnish coating over the pattern's perimeter and an area of the substrate adjacent thereto such that the varnish covers a sealing region extending at least 0.5 mm from the perimeter on both sides thereof. An article of manufacture comprises a non-fibrous outer surface having a 3D decorative pattern applied thereto and coated with a varnish coating covering a sealing region extending at least 0.5 mm from the pattern's perimeter on both sides thereof.

14 Claims, 5 Drawing Sheets

(52) U.S. Cl.
CPC ..... *B41M 7/0054* (2013.01); *B41M 3/16* (2013.01); *Y10T 428/13* (2015.01); *Y10T 428/131* (2015.01); *Y10T 428/1397* (2015.01); *Y10T 428/24802* (2015.01)

(58) Field of Classification Search
CPC .... B41M 3/16; B41M 7/0036; B41M 7/0045; B41M 7/0054
See application file for complete search history.

(56) References Cited

U.S. PATENT DOCUMENTS

| | | | |
|---|---|---|---|
| 6,004,419 | A | 12/1999 | Torii |
| 2002/0142106 | A1 | 10/2002 | Bethune |
| 2011/0247749 | A1 | 10/2011 | Chang |
| 2012/0015162 | A1 | 1/2012 | Lion |

FOREIGN PATENT DOCUMENTS

| | | | |
|---|---|---|---|
| FR | 2817196 | A1 | 5/2002 |
| JP | 56030473 | A | 3/1981 |
| JP | 2010047308 | A | 3/2010 |

OTHER PUBLICATIONS

Expancel Brochure, Expancel is a company within Akzo Nobel producing and marketing microspheres.

PROCESS FOR PRINTING AND SECURING THREE-DIMENSIONAL PATTERN ON NON-FIBROUS SUBSTRATES AND ARTICLE COMPRISING NON-FIBROUS SURFACE HAVING THREE-DIMENSIONAL PATTERN THEREON

FIELD OF THE INVENTION

The present invention is directed to a method of printing and securing a three-dimensional pattern on non-fibrous substrates, such as, for example, plastic, metal, or glass surfaces of various implements, devices, containers, packages, and the like.

BACKGROUND

The current market's demands encourage manufacturers of consumer goods to create new decorative patterns on items and containers that would appeal to consumers. One of the desirable features of such decorative patterns typically includes insignia having a three-dimensional relief extending over the surface of the underlying surface. Such three-dimensional pattern can be accomplished by a variety of means, including printing. Various printing techniques known in the art include, e.g., offset printing, screen printing, photo printing, flexography, letterpress printing, jet printing, and others.

Silkscreen printing, for example, is a method of stencil print making in which a design is imposed on a screen of polyester or other fine mesh, with blank areas coated with an impermeable substance. Ink is forced into the mesh openings by the fill blade or squeegee and onto the printing surface during the squeegee stroke. Pad printing is a printing process that can transfer a 2-D image onto a 3-D object. This is accomplished using an indirect offset printing process that involves an image being transferred from the image plate via a silicone pad onto a substrate. Ink-jet printing is a type of digital printing that creates an image by propelling droplets of ink onto a substrate, such as, e.g., paper or plastic.

The use of expanding agents in inks is also known. For example, U.S. Pat. No. 3,615,972 describes thermoplastic microspheres that encapsulate a liquid blowing agent, wherein heating of the microspheres causes their expansion. U.S. Pat. No. 6,004,419 describes a heat-transfer printing sheet and a thermally-expandable ink layer formed thereon, comprising as an expanding agent a thermally-expandable micro-capsule containing easily volatilizable hydrocarbon and a binder resin. EP-A-0348372 describes a method and an apparatus for producing expanded thermoplastic microspheres without agglomerate formation. US 20120015162 is directed to a coated material, including a support, covered with at least one layer of polymer resin that includes heat-expandable microspheres. US 20110247749 is directed to a process for coating a foamed material on a container, including preparing a coating material by heat-blending or kneading a solid thermoplastic binder with a solid thermo-expandable powder consisting of a plurality of solid thermo-expandable microcapsules. US 20020142106 is directed to a method for applying decoration to a support including depositing an ink solution on the support, wherein the ink solution contains thermally expandable particles, and a microwave device is used to the thermally expandable particles, contained in the ink solution, expand.

One of the challenges facing manufacturers of articles having three-dimensional decorations on plastic, metal, and other non-fibrous surfaces is ensuring the lasting durability of the decorations, under the conditions of making, transporting, and using the article. The fact that fibrous materials have pores and typically possess good capillary properties makes the fibrous materials are particularly well suited for receiving and securely retaining three-dimensional patterns applied thereto. Non-fibrous materials, on the other hand, do not have fibers and therefore are poorly suited for this purpose since the non-fibrous materials cannot exhibit good fiber-capillary properties. The retention and durability of a three-dimensional pattern applied to a non-fibrous substrate is a particularly challenging task for manufacturers of articles that have non-planar shape of the external surface (such as, e.g., bottles, having a generally concave shape) and that often experience surface deformation and harsh contact with other similar articles and/or items (such, e.g., as packaging crates) during handling, shipping, and ultimate use by a consumer.

The present invention is directed to a process for making a stable and durable three-dimensional pattern on a non-fibrous substrate.

SUMMARY OF THE INVENTION

In its process aspect, the invention comprises a process for creating a stable and durable three-dimensional pattern on a non-fibrous substrate. Non-limiting examples of non-fibrous substrates include surfaces of various consumer product: metal, plastic, and glass bottles, jars, and cans; cosmetic devices, such as, e.g., mascara bottles and wands and other applicator-type implements; various shaving implements, such as, e.g., razors and electric shavers; hair brushes and devices for hair drying and/or styling; manual and electric toothbrushes; and other implements and small appliances having non-fibrous surfaces suitable for receiving a three-dimensional decorative pattern.

The process comprises depositing a heat-expandable composition on a non-fibrous substrate in a predetermined pattern; heating the disposed heat-expandable composition to a temperature of 100° C. to 220° C. to cause the heat-expandable composition to expand in volume, thereby forming a three-dimensional pattern of the composition, the three-dimensional pattern having an overall surface area and a perimeter comprising a boundary line between the composition and the non-fibrous substrate; cooling the three-dimensional pattern of the composition to less than 40° C.; and applying a varnish coating over the perimeter of the pattern of the composition and an area of the non-fibrous substrate adjacent thereto such that the varnish covers a sealing region extending at least 0.5 mm from the perimeter of the pattern on both sides thereof, thereby securing the three-dimensional pattern of the composition on the non-fibrous substrate.

The non-fibrous substrate can be selected from the group consisting of glass, plastic, and metal and can have a convex surface, a concave surface, and an irregularly curved surface. Non-fibrous substrate is a material that does not contain fibers, i.e., micro-strings or micro-ropes composing fibrous materials such as paper, wood, textile, felt, cloth, and the like.

The heat-expandable composition may include heat-expandable microsphere particles comprising hydrocarbon encapsulated by a gas-tight thermoplastic shell having an expanded diameter of 20 to 200 μm. One example of such heat-expandable composition is EXPANCEL® particles, available from AkzoNobel Corporation of the Netherlands. The heat-expandable composition can be deposited to a non-fibrous substrate using any suitable means known in the art, e.g., screen printing, pad printing, and rotogravure.

The sealing varnish coating can comprise a varnish selected from a solvent-based varnish, a water-based varnish, and a UV-curable varnish. The sealing varnish is typically a transparent, hard, protective finish or film. The solvent-based varnish can be dried and/or cured by evaporation of a solvent contained therein. The water-based varnish can be dried and/or cured by evaporation of water contained therein. The UV-curable varnish can be cured by exposure to ultraviolet (UV) light.

The varnish coating is applied to at least a sealing region. The sealing region is a region that includes a perimeter comprising a boundary line between the heat-expandable composition and the non-fibrous substrate and an area extending at least 0.5 mm from the perimeter on both sides thereof. The sealing region, therefore, includes at least a portion of the outer surface of the heat-expandable composition and an adjacent portion of the non-fibrous substrate.

In one embodiment, the sealing region may comprise at least 60% of the overall surface area of the three-dimensional pattern. In another embodiment, the sealing region may comprise at least 80% of the overall surface area of the three-dimensional pattern. In yet another embodiment, the sealing region may comprise at least 90% of the overall surface area of the three-dimensional pattern. In still another embodiment, the sealing region may comprise, in size, at least 100% of the overall surface area of the three-dimensional pattern. In one further embodiment, the sealing region may cover the entire overall surface area of the three-dimensional pattern.

In its product aspect, the invention comprises an article of manufacture having a non-fibrous outer surface and a three-dimensional decorative pattern attached thereto and comprising a solidified heat-expandable composition, the three-dimensional decorative pattern having an external surface area and a perimeter comprising a boundary line between the three-dimensional decorative pattern and the non-fibrous outer surface, wherein the three-dimensional decorative pattern and the non-fibrous outer surface are at least partially coated with a varnish coating such that the varnish coating covers at least the perimeter of the three-dimensional decorative pattern and a sealing region extending at least 0.5 mm from the perimeter on both sides thereof, thereby securing the three-dimensional decorative pattern to the non-fibrous outer surface of the article.

The article of manufacture can be made of any non-fibrous material, such as, e.g., plastic, glass, or metal. Alternatively, the article of manufacture can be made from any suitable material, including a fibrous material, wherein the outer surface of the article includes an area of a non-fibrous material. The non-fibrous outer surface may have any shape, such as, e.g., a flat shape and a non-flat shape, including, without limitation, a concave shape, a convex shape, an irregularly shape surface, or any combination thereof.

DETAILED DESCRIPTION OF THE INVENTION

Figure 1:
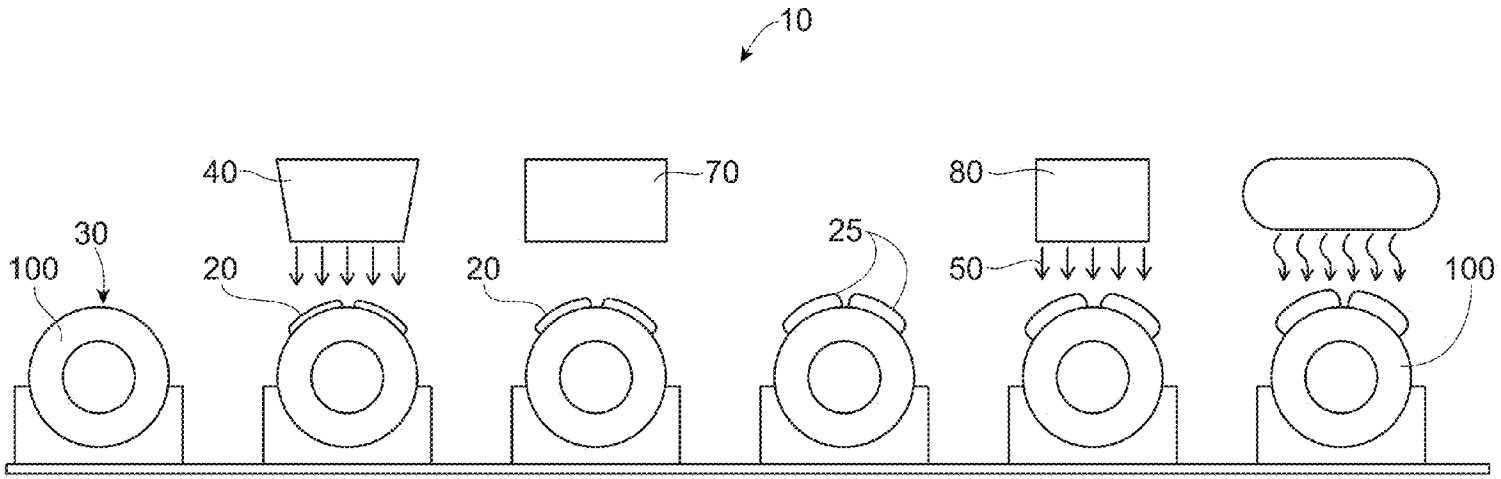
FIG. 1 is a schematic view of an embodiment of a process of the invention.

The first step of a process 10 for creating a stable and durable three-dimensional pattern 25 on a non-fibrous substrate 30 comprises depositing a heat-expandable composition 20 on a non-fibrous substrate 30 in a predetermined pattern (FIG. 1). As used herein, the term "heat-expandable composition" refers to an ink-containing liquid mixture that includes particles comprising polymeric capsules filled with volatile gas. The polymeric capsules may comprise, e.g., vinyl chlorides, vinylidene chlorides, acrylonitriles, methyl methacrylates, and styrenes. The particles may contain a gas comprising, e.g., freon or hydrocarbon.

Upon being heated, these heat-expandable particles expand to occupy larger space. The particles may expand by 20, 30, 40, or 50 times the particle's initial volume. Some particles may have an expanded equivalent diameter from 20 μm to 200 μm, for example. The heat-expandable particles may have any shape, such as, e.g., spherical, ellipsoidal, irregular, or any other shape. As used herein, the term "equivalent diameter" (or simply "diameter") refers to the real diameter of a spherical particle or the maximum dimension of a non-spherical particle. In the latter instance, the term "diameter" relates to the diameter of an imaginary sphere circumferentially encompassing the non-spherical particle. One example of such heat-expandable composition comprises EXPANCEL® microspheres, which contain liquid hydrocarbon encapsulated by a gas-tight thermoplastic shell from 10 to 40 μm in diameter. When heated, the gas expands and causes a dramatic increase in the volume of the spheres.

The heat-expandable composition 20 may comprise a decorative color pigment or pigments and a filler. The content of the color pigment and the filler is determined by a specific application, but generally can be in the range from about 0.1% to about 15% by weight of the heat-expandable composition 20. Other particulate or liquid materials can be added to the composition 20 to enhance the resulting aesthetic appearance of the three-dimensional pattern 25 being made.

As used herein, the term "non-fibrous substrate" refers to any substrate having an outer surface that does not have fibrous structure. Non-fibrous substrates do not contain fibers, i.e., micro-strings or micro-ropes composing fibrous materials such as paper, wood, textile, felt, cloth, and the like. Fibrous materials, which can be viewed as a mixture of fiber and air, are not classical continuum; they are, instead, inherently discrete due to the presence of macro-pores therein. (See, e.g., Ning Pan, On Uniqueness of Fibrous Materials, Design & Nature II. Eds: Collins, M. and Brebbia, C. WIT Press, Boston, 2004; 493-504.) Such fibrous materials typically possess abundant fiber-capillary properties, which considerably facilitates the retention of a three-dimensional pattern applied thereto. The non-fibrous materials, such as, e.g., plastic, glass, and metal, which do not contain fibers, lack such fiber-capillary properties—which makes the retention of a three-dimensional pattern applied to the non-fibrous substrate much more difficult. The process of the present invention is suitable for a non-fibrous substrate 30 having a flat surface, a convex surface, a concave surface, an irregularly curved surface, or any combination thereof. Non-limiting examples of articles having on outer surface comprising the non-fibrous substrate 30 include a container, a bottle, a box, and the like—or a label, either flat or curved, designed to be attached to a container, a bottle, a box, or any other type of article.

The heat-expandable composition 20 can be deposited to the non-fibrous substrate 30 by any suitable method known in the art, e.g., offset printing, gravure, flexography, letterpress printing, and pad printing. FIG. 1, for example, schematically shows an embodiment of the process 10 in which the heat-expandable composition 20 is deposited to the non-fibrous substrate 30 by a pad printer 40. Generally, pad printing is a printing process that can transfer a two-dimensional (2-D) image onto a three-dimensional (3-D) object or pattern. This can be accomplished using an indirect offset-printing process that involves an image being transferred from an image plate via a silicone pad onto a substrate.

Other printing methods, such as, e.g., ink-jet printing or silkscreen printing, can also be used to deposit the heat-expandable composition to the non-fibrous substrate. Ink-jet printing is a type of digital printing that creates an image by propelling droplets of ink onto a substrate. Silkscreen printing is a stencil printing method in which a design is imposed on a fine-mesh screen of polyester or other suitable material, with blank areas coated with an impermeable substance. Ink is then forced into the mesh openings by the fill blade or squeegee and onto the printing surface during the squeegee stroke. The above examples are non-limiting printing techniques; and other methods of depositing the heat-expandable composition to the non-fibrous substrate can be used in the process of the invention.

Figure 2:
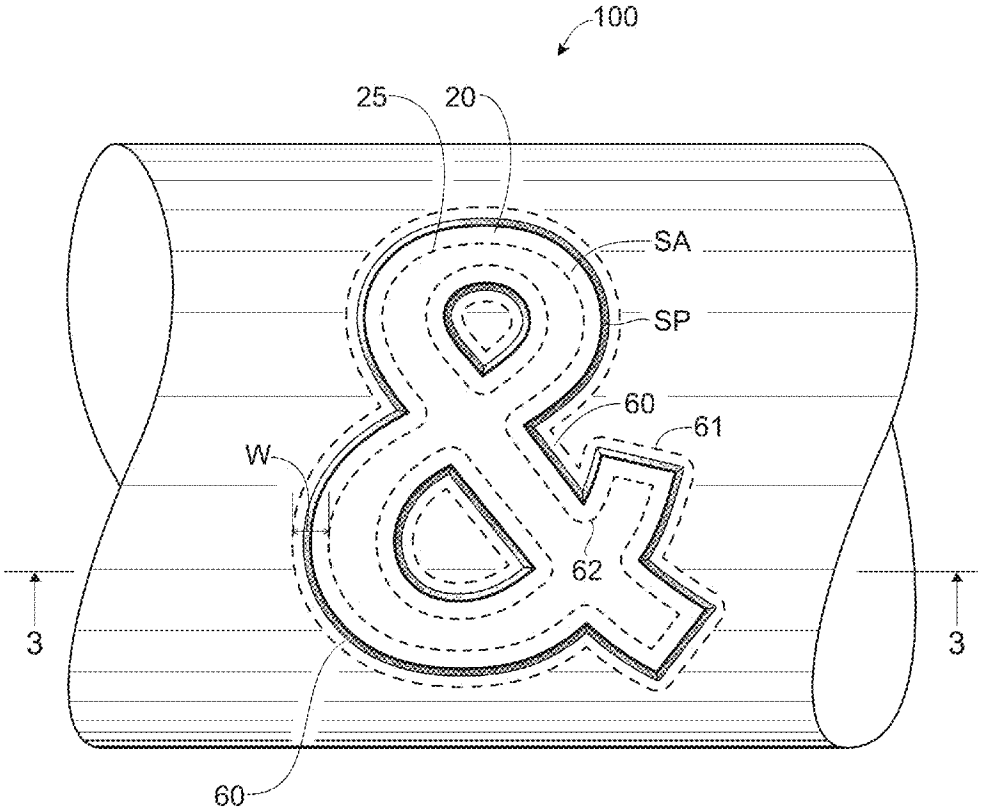
FIG. 2 is a schematic view of an embodiment of the three-dimensional decorative pattern affixed to a non-fibrous surface of an article of manufacture according to the disclosure.

The heat-expandable composition 20 can be deposited to the substrate 30 in any desirable predetermined pattern. Such a predetermined pattern may include various insignia, including letters, emblems, signs, and the like, and comprising, e.g., trademarks, trade names and other identification words or symbols. FIG. 2 shows an example of the three-dimensional pattern 25 comprising an ampersand symbol ("&").

After the heat-expandable composition 20 has been deposited to the surface of the non-fibrous substrate 30 in a predetermined pattern, a step of expanding the heat-expandable composition 20 can be performed to cause the composition 20 to increase its volume, thereby forming a three-dimensional structure, or pattern 25 on the surface of the substrate 30. Depending on the type of the heat-expandable composition 20, the heat-expandable composition 20 may be heated to a temperature of from 100° C. to 400° C. The EXPANCEL® microspheres, for example, may be heated to a temperature of 175° C. to achieve a desired expansion thereof.

Any suitable means for heating the heat-expandable composition 20 may be used. For example, the heat-expandable composition 20 can be heated by such conventional heating means as infra-red heater, heating tunnel, and the like. Additionally or alternatively, the heat-expandable composition 20 may be subjected to microwave radiation, from a microwave device 70, generating suitable wave frequencies. In one exemplary embodiment, the microwave radiation frequency ranges from 100 MHz to 300 GHz. The microwave radiation may have a benefit of changing the orientation of water molecules present in the heat-expandable composition 20, thereby causing the composition 20 to raise the temperature very rapidly. This, in turn, causes the heat-expandable composition's particles to expand fast.

The heat-expandable composition 20, deposited on the non-fibrous substrate 30, may be dried simultaneously with the composition 20 being conventionally heated and/or microwaved, i.e., simultaneously with the expansion of the particles of the composition 20 deposited on the substrate 30. In such an embodiment, no additional time dedicated just to drying is needed. Thus, an embodiment of the process in which expansion and drying occur simultaneously may provide time savings.

Once the heat-expandable composition 20 has expanded to form the desired three-dimensional pattern 25 on the substrate 30, the composition can be cooled to the temperature of less than 40° C. Cooling may be performed by exposing the three-dimensional pattern 25 to ambient temperatures. Additionally, cooling means, such as, e.g., fans (not shown), can be utilized to expedite the cooling of the three-dimensional pattern 25.

Figure 3:
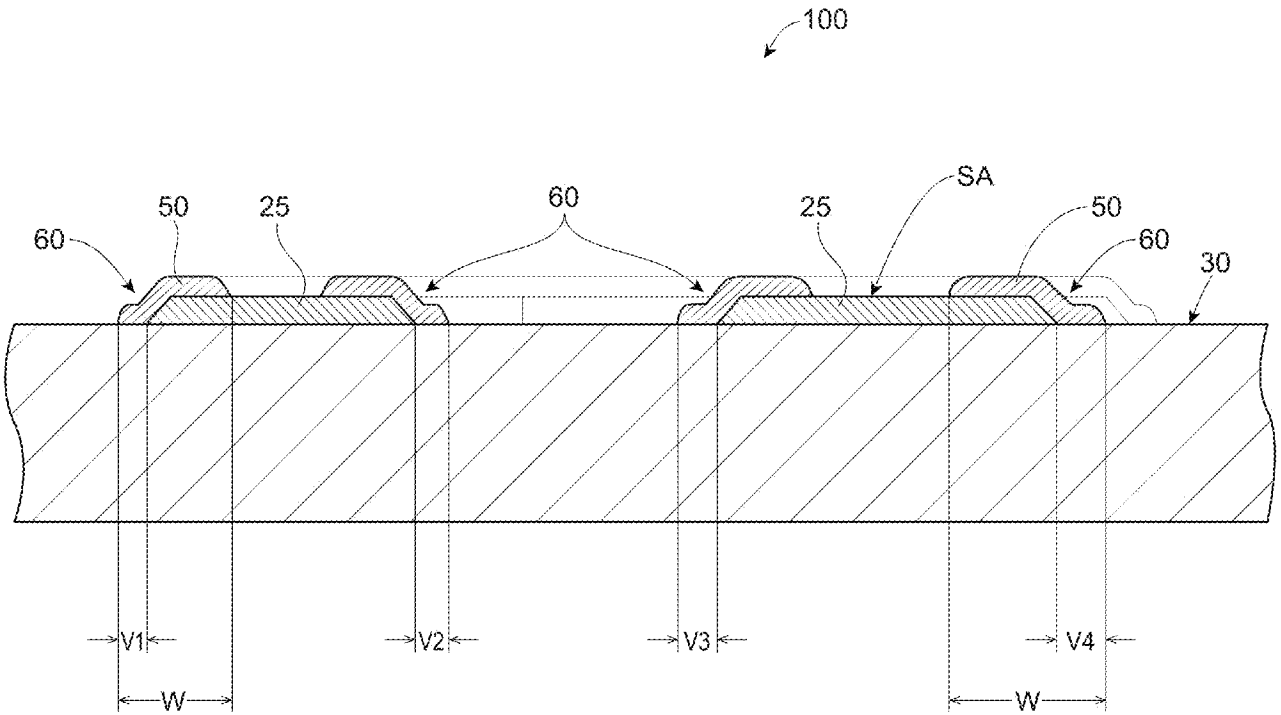
FIG. 3 is a schematic cross-sectional view of the three-dimensional pattern shown in FIG. 2 and taken along the lines 3-3.

FIGS. 2 and 3, schematically show a fragment of an article of manufacture having the three-dimensional pattern 25 disposed on the article's non-fibrous surface 30. The three-dimensional pattern 25 has an overall surface area SA and an outer-surface perimeter SP. The outer-surface perimeter (or simply "perimeter") SP comprises an external boundary line between the heat-expandable composition 20, disposed on the surface 30 in the form of the three-dimensional pattern 25, and the substrate 30. Thus, the perimeter SP circumferentially encompasses the three-dimensional pattern 25, and the surface area SA is disposed inside the perimeter SP.

Once the three-dimensional pattern 25 is cooled to the desired temperature, a protective varnish coating 50 can be applied over the perimeter SP of the three-dimensional pattern 25 and a sealing region 60 adjacent to the perimeter SP. The sealing region 60 is an area extending to at least 0.5 mm from the perimeter SP on both sides of the perimeter SP. In other words, the sealing region 60 is an area having a width W of at least 1 mm and a general configuration, of the three-dimensional pattern 25, as shown in the exemplary pattern shown in FIGS. 2 and 3. The sealing region 60 includes at least a portion of the outer surface SA of the three-dimensional pattern 25 of the heat-expandable composition 20 and an adjacent area of the non-fibrous substrate 30. In FIG. 2, the sealing region 60 is illustrated as comprising an area encompassed by lines 61 and 62. In FIG. 3, the width W of the sealing region 60 includes areas having widths V1, V2, V3, and V4 of at least 0.5 mm and extending from an edge of the pattern (or the perimeter SP) on both sides thereof.

The sealing region 60 may have a width of at least 1.5 mm, at least 2 mm, at least 2.5 mm, at least 3 mm, at least 3.5 mm, at least 4 mm, or at least 5 mm. The sealing region 60 may comprise at least 60%, at least 70%, at least 80%, at least 90%, or at least 100% of the overall surface area SA of the three-dimensional pattern 25. One skilled in the art would readily understand that in an article in which the sealing region 60 comprises at least 100% of the overall surface area SA of the three-dimensional pattern 25, the varnish coating 50 may cover the entire surface area SA of three-dimensional pattern 25.

The varnish coating 50 may comprise a composition selected from a solvent-based varnish, a water-based varnish, and a UV-curable varnish. A sealing varnish is typically a transparent, hard, protective finish or film. As one skilled in the art will readily recognize, the solvent-based varnish can be dried and/or cured by evaporation of a solvent contained therein; the water-based varnish can be dried and/or cured by evaporation of water contained therein; and the UV-curable varnish can be dried cured by exposure to ultraviolet (UV) light. Non-limiting example of the varnish coating 50 includes acrylate-based UV clear varnish.

Any suitable method of applying the varnish coating 50 can be utilized in the invention. The varnish coating 50 can be applied, e.g., by using an inkjet printer 80, FIG. 1. An example, below, describes an embodiment of the process wherein an inkjet printer has been used to apply the varnish coating 50 to the sealing region 60 of a non-fibrous surface of a flame-treated HDPE bottle.

EXAMPLE

An HDPE bottle has been flame-treated to achieve higher surface energy and creation of polar sites to improve adhesion with the ink and chemical cross linking with the varnish. Flame treatment—is a controlled, rapid, cost-effective method of increasing surface energy and wettability of polyolefins and metallic components. This high-temperature treatment uses ionized gaseous oxygen via jet flames across a surface of the substrate to add polar functional groups to the surface while melting the surface molecules and locking them into place upon cooling.

An exemplary test composition can comprise from about 1% to about 20% by dry weight of EXPANCEL® 909 DU 80 particles, expending from 40 to 200 microns in diameter; from about 40% to about 80% of a binder, resin and solvent, or plasticizer; from about 0.1% to about 20% of a pigment and filler; and from about 2% to about 35% of other (optional) substances, such as, e.g., thickeners, dispersants, et cetera.

In the test, a solvent-based silkscreen-printing ink, NUPUFF Dark Brown 0080181, available from The Jay Products Co. of Cincinnati, Ohio, has been mixed with about 10% EXPANCEL® 909 DU 80 particles. A water-based or solvent-based ink is a liquid or paste that contains pigments used to color a surface to produce an image, text, or design. Typically, it contains a dispersant that prevents the aggregation or agglomeration of the pigment particles or other particulate components of the composition. Once applied to the surface of the substrate, the water or solvent starts to evaporate. This causes the creation of a film on the substrate. Other silkscreen-printing inks contain resins, such as acrylics or vinyls and plasticizers, e.g., benzoate esters and phthalates esters. Coating of such inks on a substrate followed by heating results in the swelling of the resin, absorption of the plasticizer, and the creation of a flexible film on the substrate.

The resulting composition has been silkscreened on the flame-treated HDPE bottle, to form an ornamental, essentially two-dimensional pattern. Then, the printed pattern has been immediately exposed to an infra-red (IR) heater, which has rapidly increased the temperature of the composition of the printed pattern to about 175° C. This has caused the microspheres of the composition to expand to about 80 microns, thereby forming a well-defined three-dimensional pattern from the essentially two-dimensional pattern. This heating also cured the composition comprising the three-dimensional pattern.

After the three-dimensional pattern has been cooled to a room temperature, a varnish coating comprising acrylate-based UV-clear varnish has been applied to the three-dimensional pattern and the adjacent area of the underlying surface of the bottle. The acrylate-based UV-clear varnish Roland ECO-UV, EUV-GL is available from Trigon Imaging Systems, 575 Chamber Drive, Milford, Ohio. The application of varnish has been done by a flat-bed inkjet printer Roland LEF-12, manufactured by the Roland Corporation of Japan.

The varnish coating has covered at least 80% of the three-dimensional pattern's overall surface area and an area extending about 1 mm beyond the three-dimensional pattern's external perimeter at both sides thereof. Thereafter, the varnish coating has been cured by ultra-violet (UV) radiation, by a 380-420 nm LED UV lamp.

To test the durability and resistance to peeling of the formed three-dimensional pattern under typical handling conditions, such as, e.g., mechanical stress of the bottle that may be caused by shipping/handling and consumer usage, the following test has been performed.

Figure 4A:
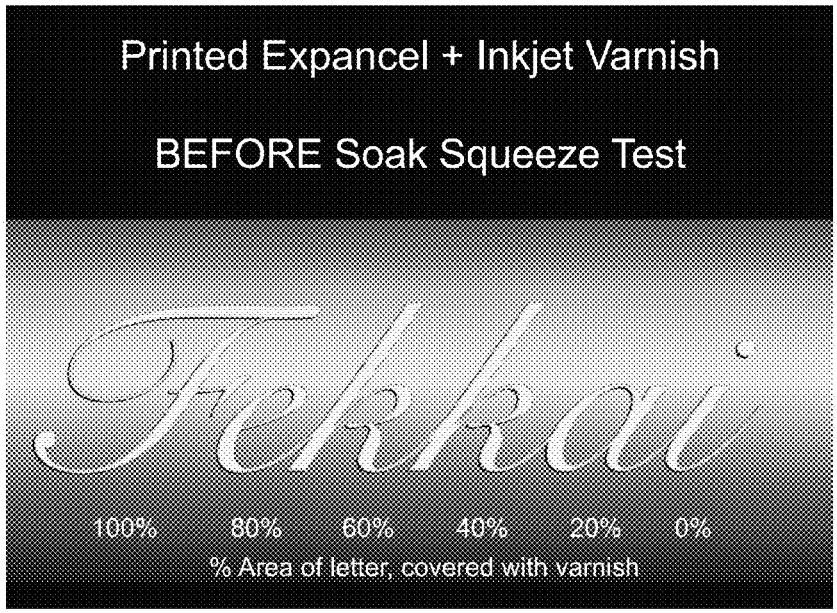
FIG. 4A is a schematic view of an exemplary embodiment of the decorative three-dimensional pattern having a varnish coating applied thereto, before a soak-and-squeeze test procedure.
Figure 4B:
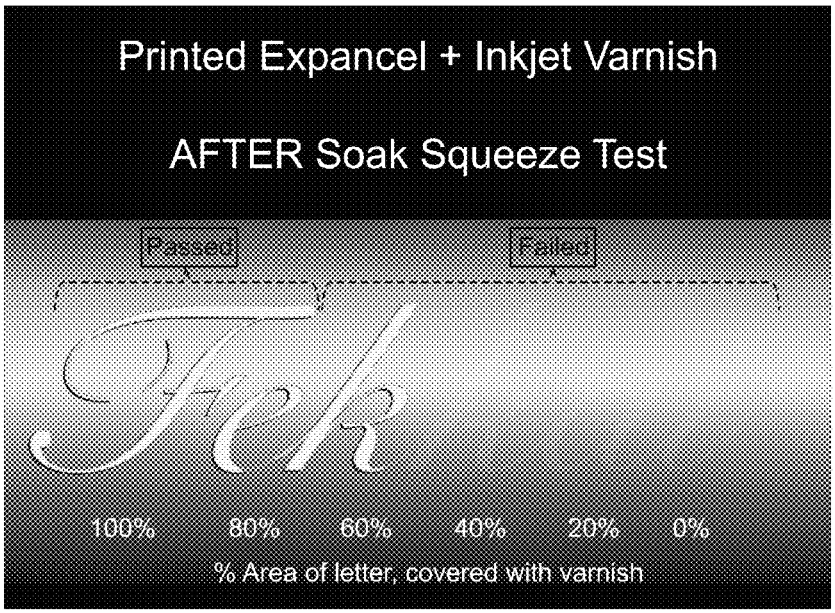
FIG. 4B is a schematic view of the decorative three-dimensional pattern shown in FIG. 4A, after being subjected to the soak-and-squeeze test procedure.

Reference is made to FIGS. 4A and 4B. FIG. 4A shows a view of a fragment of the experimental bottle having insignia "Fekkai" comprising the three-dimensional pattern covered by the sealing varnish composition, as described herein, before the test. In FIG. 4A, the varnish coating, having a thickness of about 8 microns, has covered at least 100% of the overall outer surface of the letter "F"; about 80% of the overall outer surface of the letter "e"; about 60% of the overall outer surface of the first letter "k"; about 40% of the overall outer surface of the second letter "k"; and about 20% of the overall outer surface of the letter "a." The varnish coating has not been applied over the letter "i" at all. With respect to all the letters that have been covered by the varnish coating, the varnish-coating coverage has extended to also cover an area of the adjacent underlying substrate at the distance of about 1 mm from the external perimeter of the three-dimensional pattern.

The bottle has been left for 24 hours at ambient conditions. Then, the bottle with the fully solidified three-dimensional pattern "Fekkai" and the varnish coating, as described herein, has been subjected to a soak-and-squeeze test, designed to assess the robustness of labels and direct-decorated bottles. The test comprises essentially of series of soaking and squeezing of the bottle—to mimic consumer usage. The test can also be used to include an accelerated-stress-storage step to simulate aging of the label or a directly applied decoration.

More specifically, the bottle has been soaked, for about one hour, in a constant-temperature bath filled with a surfactant solution having a temperature of about 38° C. To prepare the surfactant, a light-duty liquid (LDL), such as, e.g., DOWN BLUE® has been thoroughly mixed into the water to a concentration of about 5 gram of LDL per 1 liter of water; and a shampoo, e.g., PANTENE CLARIFYING® has been thoroughly mixed into the water to a concentration of about 5 gram of shampoo per 1 liter of water. The bath temperature controls have been set to maintain 38 (±1° C.; and testing should begin when the temperature reaches 38° C.

The bottle, having three-dimensional pattern "Fekkai" and the varnish coating, as described herein, has been filled with the surfactant solution and submerged in the 38° C. surfactant bath for one hour. While the bottle is inside the surfactant solution, the bottle has been squeezed at the front and back for 10 times. If necessary, the bottle can be returned to its original shape by being squeezed opposite the crease. This constitutes one cycle. (After each treatment cycle the sample can be graded by visual inspection.) The test is repeated for a total of 5 cycles (or 50 squeezes). Then, the bottle is allowed to remain submerged at 38° C. overnight. The test is then repeated for 5 more cycles. The total number of cycles is, therefore, ten (or 100 squeezes). The final grading/inspection can determine any detects in the three-dimensional pattern, including separation of the pattern from the surface of the bottle, such as flaking ink, change in colors, and appearance.

FIG. 4B shows a view of the fragment of the bottle shown in FIG. 4A, after the test, described herein. As can be seen in FIG. 4B, the letters "F," "e," and the first "k"—which have been covered by the varnish coating at 100%, 80%, and 60%, respectively, have remained substantially adhered to the bottle's surface, although minimal separations of the most thin, and therefore most vulnerable, portions of the pattern can be observed. At the same time, the second "k" letter and the letters "a" and "i," which have been covered, respectively, at 40%, 20%, and 0% by the varnish coating, have completely peeled off.

Figure 5A:
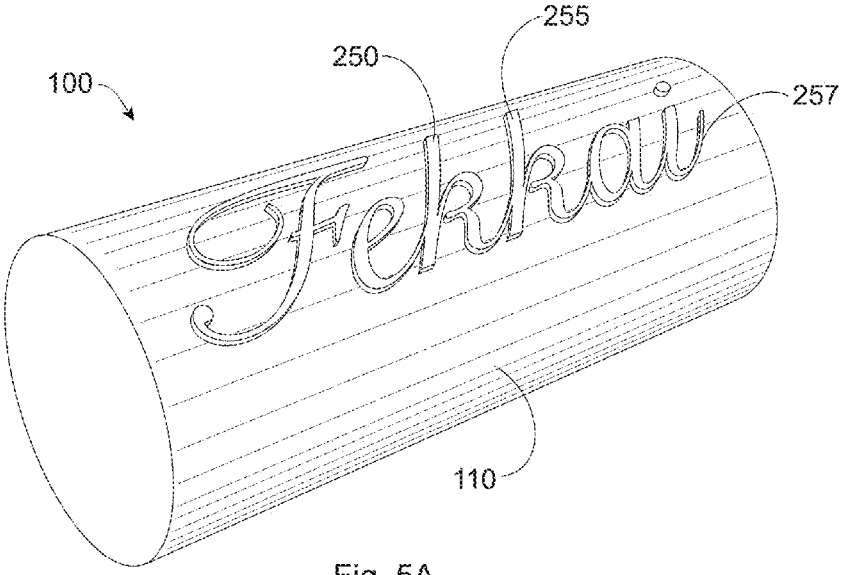
FIGS. 5A and 5B schematically show an embodiment of an article of manufacture, comprising an item having a convex non-fibrous outer surface with a stable and durable 3D decorative pattern applied thereto.
Figure 5B:
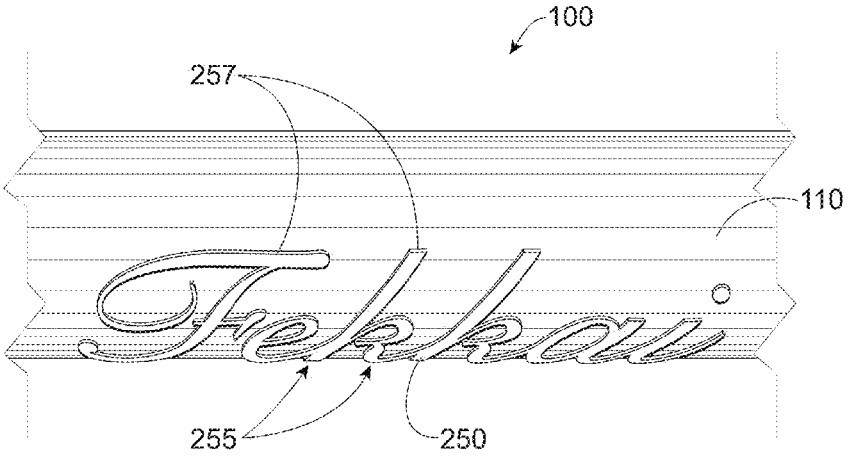

FIGS. 5A and 5B show an exemplary article of manufacture 100, comprising a non-fibrous outer surface and a stable and durable 3D decorative pattern applied thereto in accordance with the process disclosed herein. The article 100, schematically shown as a round can, has decorative 3D logo "Fekkai" inscribed on the article's convex outer surface 110. The logo comprises a three-dimensional decorative pattern 250, attached to the non-fibrous surface 110 of the article 100. The three-dimensional decorative pattern 250 comprises a solidified heat-expandable composition, as described herein. The three-dimensional decorative pattern 250 has an external surface area 255 and a perimeter 257 comprising a boundary line between the three-dimensional decorative pattern 250 and the non-fibrous outer surface 110 of the article 100. The three-dimensional decorative pattern 250 and the non-fibrous outer surface 110 of the article 100 are at least partially coated with a transparent varnish coating that covers at least the perimeter 257 of the three-dimensional decorative pattern 250 and a sealing region extending at least 0.5 mm from the perimeter 257 on both sides thereof, thereby securing the three-dimensional decorative pattern 250 to the non-fibrous outer surface 110 of the article 100.

The article of manufacture 100 can be made of any non-fibrous material, such as, e.g., plastic, glass, or metal. Non-limiting examples of non-fibrous materials include those comprising external surfaces of various consumer products, such as metal, plastic, and glass bottles, jars, and cans; cosmetic devices, such as, e.g., mascara bottles and wands and other applicator-type implements; various shaving implements, such as, e.g., razors and electric shavers; hair brushes and devices for hair drying and/or styling; manual and electric toothbrushes; and other implements and small appliances having non-fibrous surfaces suitable for receiving a three-dimensional decorative pattern. Alternatively, the article of manufacture 100 can be made of any suitable material, including a fibrous material, as long as the outer surface 110 of the article 100 includes an area of a non-fibrous material. The non-fibrous outer surface 110 of the article 100 may have any shape, such as, e.g., a flat shape and a non-flat shape, including, without limitation, a concave shape, a convex shape, an irregularly shape surface, or any combination thereof.

While particular embodiments have been illustrated and described herein, various other changes and modifications may be made without departing from the spirit and scope of the invention. Moreover, although various aspects of the invention have been described herein, such aspects need not be utilized in combination. It is therefore intended to cover in the appended claims all such changes and modifications that are within the scope of the invention.

The terms "substantially," "essentially," "about," "approximately," and the like, as may be used herein, represent the inherent degree of uncertainty that may be attributed to any quantitative comparison, value, measurement, or other representation. These terms also represent the degree by which a quantitative representation may vary from a stated reference without resulting in a change in the basic function of the subject matter at issue. Further, the dimensions and values disclosed herein are not to be understood as being strictly limited to the exact numerical values recited. Instead, unless otherwise specified, each such dimension is intended to mean both the recited value and a functionally equivalent range surrounding that value. For example, values disclosed as "80%" or "2 mm" are intended to mean "about 80%" or "about 2 mm," respectively.

The disclosure of every document cited herein, including any cross-referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein—or that it alone, or in any combination with any other reference or references, teaches, suggests, or discloses any such invention. Further, to the extent that any meaning or definition of a term in this document conflicts with any meaning or definition of the same or similar term in a document incorporated by reference, the meaning or definition assigned to that term in this document shall govern.

What is claimed is:

1. A process for creating a stable and durable three-dimensional pattern on a non-fibrous substrate, the process comprising:

(a) depositing a heat-expandable composition on a non-fibrous substrate in a predetermined pattern;

(b) causing the disposed heat-expandable composition to expand in volume, thereby forming a three-dimensional pattern of the composition, the three-dimensional pattern having an overall surface area and a perimeter comprising a boundary line between the heat-expandable composition and the non-fibrous substrate;

(c) causing the three-dimensional pattern of the composition to solidify;

(d) applying a varnish coating over the perimeter of the three-dimensional pattern and an area of the non-fibrous substrate adjacent thereto such that the varnish covers a sealing region extending a distance of from about 0.5 mm to about 5 mm from the perimeter of the three-dimensional pattern on both sides thereof, thereby securing the three-dimensional pattern of the composition on the non-fibrous substrate;

wherein the distance the sealing region extends from the perimeter of the three-dimensional pattern is substantially consistent.

2. The process of claim 1, wherein depositing a heat-expandable composition on a non-fibrous substrate comprises printing selected from the group consisting of screen printing and pad printing.

3. The process of claim 1, wherein causing the disposed heat-expandable composition to expand in volume comprises heating the disposed heat-expandable composition to a temperature of 100° C. to 220° C.

4. The process of claim 1, wherein causing the three-dimensional pattern of the composition to solidify comprises cooling the three-dimensional pattern of the composition to less than 40° C.

5. The process of claim 1, wherein the varnish coating comprises a varnish selected from a solvent-based composition, a water-based composition, and a UV-curable composition.

6. The process of claim 1, wherein the non-fibrous substrate is selected from the group consisting of glass, plastic, and metal.

7. The process of claim 6, wherein the non-fibrous substrate has a curved surface selected from a convex surface, a concave surface, and an irregularly curved surface.

8. The process of claim 1, wherein the heat-expandable composition includes heat-expandable microsphere particles comprising hydrocarbon encapsulated by a gas-tight thermoplastic shell having an expanded diameter of 20 to 200 μm.

9. The process of claim 8, wherein the heat-expandable composition comprises EXPANCEL® particles.

10. The process of claim 1, wherein applying a varnish coating comprises applying the varnish coating to the sealing region with an inkjet.

11. The process of claim 10, wherein the sealing region comprises at least 80% of the overall surface area of the three-dimensional pattern.

12. The process of claim 10, wherein the sealing region comprises at least 90% of the overall surface area of the three-dimensional pattern.

13. The process of claim 12, wherein the varnish coating comprises acrylate-based UV clear varnish.

14. The process of claim 10, wherein the sealing region comprises 100% of the overall surface area of the three-dimensional pattern.

* * * * *